US005580132A

United States Patent [19]

Rediske

[11] Patent Number: 5,580,132

[45] Date of Patent: Dec. 3, 1996

[54] INFLATABLE TRAY SEAT

[76] Inventor: Thomas E. Rediske, 150 Ammons Branch, Marshal, N.C. 28753

[21] Appl. No.: 346,752

[22] Filed: Nov. 30, 1994

[51] Int. Cl.[6] ..... A47C 27/08

[52] U.S. Cl. ..... 297/452.41; 5/655.3; 108/43

[58] Field of Search ..... 297/452.41; 108/25, 108/43, 44; 5/457, 449, 461

[56] References Cited

U.S. PATENT DOCUMENTS

| | | | |
|---|---|---|---|
| D. 106,986 | 11/1937 | Manson | 5/449 X |
| 1,242,785 | 10/1917 | Eldridge | 108/25 |
| 1,468,072 | 9/1923 | Ogle | 5/449 X |
| 2,808,191 | 10/1957 | Cramer | 108/43 X |
| 2,837,388 | 6/1958 | Majeroni | 108/25 |
| 3,147,498 | 9/1964 | Convis | 5/449 X |
| 3,171,691 | 3/1965 | Buehrig | 297/452.41 X |
| 3,244,125 | 4/1966 | Mackey | 108/25 |
| 3,833,947 | 9/1974 | Sorensen | 5/449 X |
| 3,931,652 | 1/1976 | Navarra | 5/449 X |
| 4,836,605 | 6/1989 | Greenwood et al. . | |
| 4,923,247 | 5/1990 | Malmstrom | 5/457 X |
| 5,005,702 | 4/1991 | Davis et al. | 108/43 X |
| 5,134,930 | 8/1992 | Mei-Hwa | 108/43 X |
| 5,333,336 | 8/1994 | Langsam . | |
| 5,335,968 | 8/1994 | Sheridan et al. . | |
| 5,413,035 | 5/1995 | Fernandez | 108/25 |

FOREIGN PATENT DOCUMENTS

| | | | |
|---|---|---|---|
| 1218103 | 5/1960 | France | 297/452.41 |
| 1274076 | 9/1961 | France | 5/457 |
| 63-43887 | 2/1988 | Japan | 5/457 |

*Primary Examiner*—Peter M. Cuomo
*Assistant Examiner*—David E. Allred
*Attorney, Agent, or Firm*—McHale & Slavin, P.A.

[57] ABSTRACT

An inflatable serving tray that is convertible into a booster seat. The device consists of a predefined surface area that allows for securement of a serving plate and beverage in such a manner so as to avoid spillage during consumption. Should spillage occur, a recess is provided so as to contain the spillage and direct it to the beverage holder where it can be easily removed. In addition, when the serving tray is not in use, the device may be used as a booster seat so as to raise the child to approximate the level of an average adult while seating. As a booster seat a recessed section operates to position the child correctly so as to help prevent the child from accidentally falling off the booster seat as well as contain liquids such as excess water from a child's swimming suit. A slot is provided for placement of napkins or eating utensils. Through hole chambers reduce the amount of air required for inflation and eliminate the pillowing of an inflatable device by providing internal surface support. A handle allows ease of transport and allows for securement with a seat belt.

3 Claims, 1 Drawing Sheet

INFLATABLE TRAY SEAT

FIELD OF THE INVENTION

The present invention relates to inflatable devices and more particularly to an inflatable serving tray having receptacles for securing food and beverages and which is convertible into a booster seat.

BACKGROUND OF THE INVENTION

Young children have special needs to function in a society that is geared toward adults. For instance, a child may imitate an adult by using a food and beverage serving tray while consuming a meal. However, since a serving tray is portable by design, any movement of the tray may cause spillage of the food or beverage. A serving tray that is designed to be placed over the lap of a person is especially prone to spillage when used by a child.

Seating arrangements present yet another problem to young children. Restaurants, automobiles, airplanes, theaters, stadiums and so forth typically have seating arrangements designed for adults. In many instances the child needs a booster seat in order to see out of a window or to be high enough to eat from a table.

Each of these situations may be addressed by the use of conventional serving trays and booster seats. However, a parent can not be expected to carry such items at all times. Thus, the industry has found the use of inflatable trays and booster seats as a means to resolve these problems with various degrees of success.

U.S. Pat. No. 5,134,930 discloses an inflatable serving tray formed from a rigid base with inflatable side walls and leg members. A bordered rigid support board provides a base for the food. Receptacles are available for placement of the beverages and inflatable legs allow for placement of the tray across the lap of a person. While this patent discloses an advantage of an inflatable device, the use of a rigid base defeats the primary purpose of inflating a serving tray. In addition, the legs and separate food and beverage receptacles make it inappropriate for use with small children who are likely to spill their meal as the containment area does not overlap. The tray further is limited in function as will be apparent further in this specification.

Inflatable booster seats are also known in the art such as that disclosed in U.S. Pat. No. 5,333,336 which discloses a portable seat for use in combination with stadium type seats. The disclosure is limited in application and presents a raised platform that is dangerous for use by a child if not used in conjunction with stadium style seats having arm and back support to prevent the child from slipping off the seat. It is noted that no teaching or provisions are made for correct positioning of a child.

U.S. Pat. No. 4,836,605 discloses an inflatable booster seat having a generally donut shaped seat providing sidewall support for proper positioning of a child. While this disclosure implies the need for proper positioning of a child, the practicality of the device is limited by the necessity to be secured to an underlying chair.

U.S. Pat. No. 5,335,968 discloses yet another child's booster seat having inflatable side walls placed along each side member with a back wall providing correct positioning for a child. This disclosure is directed to infants providing a seat belt for securement. The size of the device makes it impractical to store in a compact container or refill upon demand.

All known prior art is limited to either usage as a booster seat or serving tray when a combination of the two teachings is most beneficial. When combined the parent carries only one article that can be used for two different purposes. For example, when a family takes a young child to the beach, after the child returns from swimming a place is needed to sit while drying off. If the child sits on a blanket, the blanket will become soaked. If the child sits on sand, the swimsuit will be soiled. The use of a booster seat in such an application would allow the child to dry. However, booster seats of the prior art are not appropriate for the situation previously described, as they require strapping to a chair or placement within a stadium style seat.

In addition, it is most appropriate for food and beverages to be served during a beach outing wherein a device that is capable of supporting the meal off the sand makes it more pleasurable and sanitary. A greater benefit would be presented if the child could rely upon the tray to contain a spill during the meal especially if the meal is consumed in a vehicle, on a couch, or over the like expensive fabrics.

Thus, what is needed in the art is an inflatable device that is storable in a compact shape and inflates into a size that will operate as a portable serving tray or table. In addition, the device must further provide the ability to correctly position a child without the use of elaborate side and back wall support structures, thus providing a convertible device that operates for multiple functions.

SUMMARY OF THE INVENTION

The instant invention is an inflatable tray table for use by a young child that may also be used as a booster seat. The device consists of an inflatable vinyl or nylon structure having longitudinally disposed hollow inner support liners to prevent over-inflation. An upper side surface includes retention sections for positioning of a food plate, beverage, and eating utensils.

The preferred embodiment allows for a serving tray that may be used in situations where movement is possible such as when traveling in an automobile, for use as a lap table or when used as a table in windy conditions such as at a beach. The recessed areas provide for containment of spilled food and can further be used by the child as a booster seat. The seat enables the child to see out of a window, typically not possible due to the stature of a small child. For example, it is well known to parents that it is a chore to pack all the items and equipment that may be needed for the convenience of a child when traveling or taking a daily outing. A trip to the beach may entail the packing and hauling of numerous cumbersome items. Beach blankets, umbrellas, toys, towels, a cooler for food and beverages, sunscreen, and so forth may be necessary. In this instance, the present invention may have multiple uses wherein it can be used as a child's serving tray, a child's booster chair, or a novelty inflation device. When used as a serving tray or table the device enables a child to eat in a proper position having raised their food and beverage off the ground maintaining a plate, beverage container, eating utensils, and napkin in pre-determined positions so as to prevent the wind from interfering with the meal. Two corners of the device are rounded so as to prevent chafing of a child's legs when used as a table.

When the table is not in use, the device operates as a seat which allows the parent to place a barrier between their child and the ground. This prevents sand from soiling a swimsuit, prevents the child from sitting on hot sand, and provides a barrier from insects. The device can also be used as a floatation toy having handles that the child can use for support. Once the outing is over, the device can be deflated and stored into a compact position or used as an automobile booster seat wherein the handles provide direction for a seat belt and the recessed area prevents damage of a swimsuit.

Thus, an objective of the instant invention is to provide a serving tray that is storable in a compact position and is inflatable for placement of food and beverages within a contained area to resist spillage.

Another objective of the instant invention is to provide a device that operates as a booster seat to position a child's posterior. A recessed area lessens the possibility of the child from falling off the device.

Another objective of the instant invention is to provide a catch basin to prevent soiling of underlying fabric such as a vehicle seat when a child having wet clothing is placed upon the seat.

Still another objective of the instant invention is to provide an inflatable tray and booster seat having a surface available for advertising indicia thereon.

Other objectives and advantages of this invention will become apparent from the following description taken in conjunction with the accompanying drawings wherein there are set forth, by way of illustration and example, certain embodiments of this invention. The drawings constitute a part of this specification and include exemplary embodiments of the instant invention and illustrate various objectives and features thereof.

DETAILED DESCRIPTION OF THE PREFERRED EMBODIMENT

As required, a detailed embodiment of the present invention is disclosed herein; however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
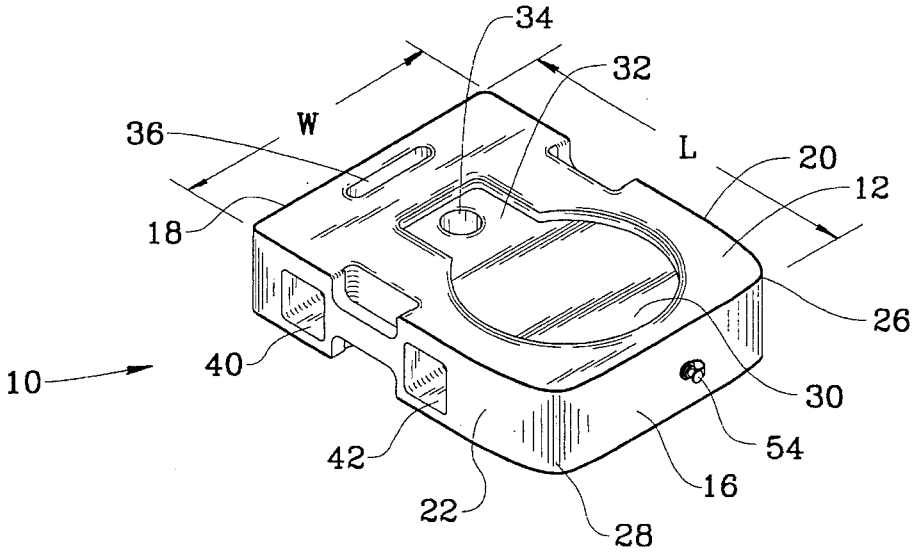
FIG. 1 is a perspective view of the instant invention.
Figure 4:
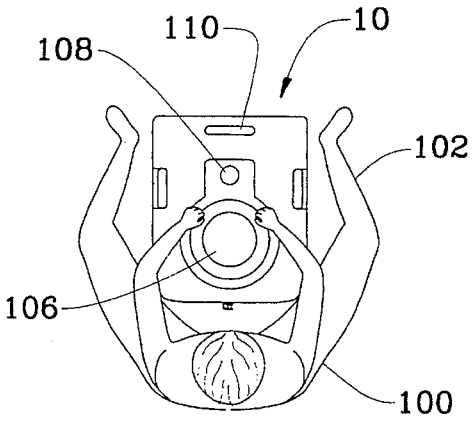
FIG. 4 is a top view of a child having the instant invention placed between their legs for use as a table.

Now referring to FIG. 1 shown is the instant invention hereinafter referred to as an inflatable tray seat 10. The invention is a combination serving platform and booster seat formed from a rectangularly shaped inflatable structure having a nominal wall thickness formed from an upper surface 12 parallelly spaced apart and sealably coupled to a lower surface 14 by four vertical side wall surfaces 16 having an equal height of about 5 inches. The tray seat 10 is constructed from vinyl, nylon or the like flexible material known for its ability to retain air. The side edge surface 16 is further defined as having a back portion 18, two side portions 20 and 22 and a front portion 24. As noted by way of illustration, side portions 20 and 22 meet the back portion 18 forming a right angle. Conversely, side portions 20 and 22 adjoin front portion 24 by use of curved corners 26 and 28 forming a directional placement which helps prevent chafing as illustrated in FIG. 4 when positioned between a child's legs for use as a table. The curvature further provides proper positioning when used as a booster seat for placement in a theater chair. For these reasons it is preferable that the width W of the device is approximately seventeen inches and the length L of the device is approximately eighteen inches.

The upper surface 12 includes a fluid containment section which consists of a first section 30 that forms the definition of a conventional plate and a second section 32 disposed at the same recessed level but is extended to encompass a circular hole 34 which operates as a cup holder or catch basin. Spillage of food or fluid from either the plate or the beverage holder will be maintained within the recessed area as defined by plate section 30 and recessed area 32. The recessed areas 30 and 32 operate to contain and direct spilled fluids into the circular hole 34 for removal at a later time. This containment area allows the serving tray to operate as a catch basin when a child is eating during movement conditions such as that associated in a vehicle or boat. The recessed area prevents spilled fluid from dropping onto the child or whatever the child is sitting on.

Slot 36 is provided for placement of napkins and eating utensils. The arrangement of the plate and cup holder teach the child proper positioning of a beverage in relation to the food without regard to left or right handed persons so as to help prevent accidental spillage of the beverage. The napkins are placed furthest from the eating surfaces for use upon completion of the meal.

The device 10 may further be used as a booster seat wherein recessed section 30 is available for proper positioning of a child. In this use as a booster seat, a child may be raised to the eye level of an average adult. For example, should a child be using the device as a booster seat while sitting in an automobile, if the child has a wet bathing suit, recessed areas 30 and 32 will lead excess water to the cup holder 34 to operate as a catch basin.

Figure 2:
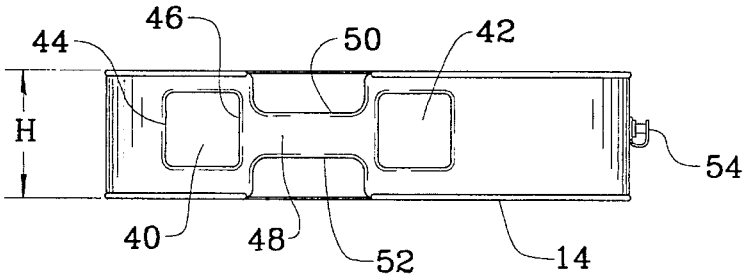
FIG. 2 is a side elevational view of FIG. 1.
Figure 3:
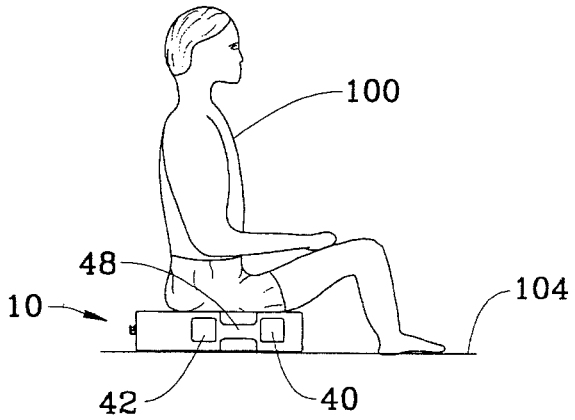
FIG. 3 is a perspective view of a child sitting on the instant invention for use as a booster seat.

Referring to FIG. 3, the child 100 can easily sit on top of the device 10 in a fashion so as to keep his body from touching the ground 104. Should the device be used on a beach, the booster seat not only operates to shield the child from hot sand which may be crawling with insects but further allows the child to dry without spoiling any garments that are wet. This would allow the child to rest while the swimsuit is drying. As previously mentioned, when the child is in the vehicle the booster seat can again be used wherein excess drippage from the swimsuit will collect in the cup holder 34 so as not to ruin cloth or leather seating of an expensive vehicle. Through holes 40 and 42 form an inner cavity through the device and are parallelly spaced apart traversing the width of the device. As shown in FIG. 2, through hole 40 has a first and second side wall 44 and 46 which operate to prevent the device from ballooning by having a side wall of a fixed distance which cannot be increased during over-inflation. In addition, a handle 48 is formed having upper side wall 50 and lower side wall 52 which provides additional support along the middle of the device to prevent pillowing at the center. The handle 48 can be formed with an opening so as to insert fingers and allow for placement of a seat belt to securely position the device and the child. A seat belt may be placed through the handles securing the child to the seat while in an automobile.

Inflation is performed by air valve 54 which is commonly used on inflatable items. The preferred embodiment includes an automatic sealing air valve which requires deforming of the valve in order to allow air to escape. A closure plug is used for insertion into the fill valve so as to prevent unintended air release.

When the device 10 is deflated, it will fold into a small container so that required storage space is kept at a minimum. This allows concealment of the device in a pocket or purse if the circumstances do not warrant the need for a serving tray or booster seat. Should the circumstances be appropriate for providing a serving tray for the child that will further help to prevent spillage of the food or for use as a booster seat, the device can be quickly inflated and used in the appropriate manner.

It is to be understood that while I have illustrated and described certain forms of my invention, it is not to be limited to the specific forms or arrangement of components herein described and shown. It will be readily apparent to those skilled in the art that various changes may be made without departing from the scope of the invention and the invention is not to be considered limited to what is shown in the drawings and described in the specification.

What I claim is:

1. A combination serving tray and portable booster seat for a child comprising: an air inflatable vinyl structure having a length along a longitudinal axis and a width along a transverse axis formed by an upper support wall spaced apart and sealingly coupled to a lower support wall by an outer continuous side wall having a height of substantially 5 inches defining an interior chamber therebetween; an air insertion means for inflation of said structure; a first recessed section providing a plate holder defined by a depression opening in said upper support wall encompassing substantially one third an area of said upper support wall and having a first continuous side wall having a height of substantially ½ inch with an upper edge coupled to an edge of said depression opening and a lower edge of said first side wall coupled to a bottom wall a second recessed section providing a cup holder defined by an aperture opening formed in said upper support wall having a second continuous side wall with an upper edge coupled to an edge of said aperture opening and a lower edge of said second side wall coupled to a bottom wall and a third recessed section defined by an elongated slot opening formed in said upper support wall having a third continuous side wall with an upper edge coupled to an edge of said slot opening and a lower edge of said third side wall coupled to a bottom wall at least two through holes extending transversely between opposite sides of said outer continuous side wall; a handle means disposed between said through holes on each of said opposite sides of said outer continuous sidewalls; whereby said sections are available for placement of a plate, eating utensils and beverage wherein said first recessed section is further available for placement of a child for use of said device as a booster seat.

2. The device according to claim 1 wherein said upper support wall has a width of substantially 17 inches and a length of substantially 18 inches.

3. The device according to claim 1 wherein said first recessed section is available for placement of advertising indicia.

* * * * *